US009229469B2

(12) United States Patent
Maruyama et al.

(10) Patent No.: US 9,229,469 B2
(45) Date of Patent: Jan. 5, 2016

(54) REACTIVE FORCE PEDAL DEVICE

(71) Applicants: HONDA MOTOR CO., LTD., Minato-ku, Tokyo (JP); MITSUBA CORPORATION, Kiryu-shi, Gunma (JP)

(72) Inventors: Kohei Maruyama, Utsunomiya (JP); Hideto Nebuya, Utsunomiya (JP); Naoto Sen, Utsunomiya (JP); Terumasa Hoshino, Midori (JP); Tsuyoshi Maruyama, Ota (JP); Yasunori Noro, Kiryu (JP)

(73) Assignees: Honda Motor Co., Ltd., Tokyo (JP); Mitsuba Corporation, Gunma (JP)

( * ) Notice: Subject to any disclaimer, the term of this patent is extended or adjusted under 35 U.S.C. 154(b) by 0 days.

(21) Appl. No.: 14/368,613

(22) PCT Filed: Dec. 10, 2012

(86) PCT No.: PCT/JP2012/081988
§ 371 (c)(1),
(2) Date: Jun. 25, 2014

(87) PCT Pub. No.: WO2013/099581
PCT Pub. Date: Jul. 4, 2013

(65) Prior Publication Data

US 2014/0373668 A1 Dec. 25, 2014

(30) Foreign Application Priority Data

Dec. 27, 2011 (JP) ..... 2011-285467

(51) Int. Cl.
*G05G 1/30* (2008.04)
*G05G 1/40* (2008.04)
*G05G 5/03* (2008.04)

(52) U.S. Cl.
CPC .. *G05G 1/40* (2013.01); *G05G 1/30* (2013.01); *G05G 5/03* (2013.01); *Y10T 74/20534* (2015.01)

(58) Field of Classification Search
CPC ..... G05G 1/30; G05G 1/40; G05G 1/44; B60K 26/021; B60T 7/04; Y10T 74/20888; Y10T 74/20528; Y10T 74/20534
See application file for complete search history.

(56) References Cited

U.S. PATENT DOCUMENTS 6,745,642 B2 6/2004 Kumamoto et al.
7,234,370 B2 6/2007 Kim (Continued)

FOREIGN PATENT DOCUMENTS

CN 1608886 A 4/2005
CN 101081614 A 12/2007

(Continued)

OTHER PUBLICATIONS

Office Action dated Dec. 17, 2014 issued in the corresponding Chinese Patent Application 201280064501.5.

*Primary Examiner* — Thomas Diaz
(74) *Attorney, Agent, or Firm* — Carrier Blackman & Associates, P.C.; William D. Blackman; Joseph P. Carrier

(57) ABSTRACT

In a reactive force pedal device, between a motor-side output shaft and a pedal member, a one-way clutch is provided which allows transmittance of rotational force when performing a depressing operation of the pedal member and disables transmittance of the rotational force when performing a revert operation of the pedal member.

8 Claims, 6 Drawing Sheets

(56) References Cited

U.S. PATENT DOCUMENTS

| | | | | |
|---|---|---|---|---|
| 7,568,545 | B2 | 8/2009 | Tanigawa et al. | |
| 7,770,491 | B2 * | 8/2010 | Ritter et al. | 74/560 |
| 8,333,130 | B2 | 12/2012 | Fujiwara | |
| 2013/0152725 | A1 | 6/2013 | Maruyama et al. | |

FOREIGN PATENT DOCUMENTS

| | | | | |
|---|---|---|---|---|
| CN | 101186195 | A | 5/2008 | |
| EP | 1375233 | A1 * | 1/2004 | B60K 26/02 |
| JP | S60-164228 | U | 10/1985 | |
| JP | 11-264707 | A | 9/1999 | |
| JP | 2005-132225 | A | 5/2005 | |
| JP | 2007-026218 | A | 2/2007 | |
| JP | 2010-003164 | A | 1/2010 | |
| WO | 01/19638 | A1 | 3/2001 | |
| WO | 2009/136512 | A1 | 11/2009 | |
| WO | 2012/029503 | A1 | 3/2012 | |

* cited by examiner

10
ECU
16
POWERTRAIN SYSTEM
14
θ
Sm
12
ACCELERATOR PEDAL DEVICE
URGING FORCE GENERATOR
24
RETURN SPRING
40
HYSTERESIS PROPERTY GENERATOR
42
OPERATION AMOUNT SENSOR
44
Fs1
PEDAL-SIDE ARM
22
Fs2+Fm
MOTOR-SIDE ARM
28
Fs1+Fs2+Fm
30
PAD
20
REACTION FORCE GENERATOR
26
DRIVER
52
MOTOR
50
Fm
SPEED REDUCER
54
Fs2+Fm

FIG. 6

| | SPEED REDUCER OUTPUT SHAFT | ONE-WAY CLUTCH (INNER CLUTCH ELEMENT) | ONE-WAY CLUTCH (OUTER CLUTCH ELEMENT) | TORQUE LIMITER (INNER LIMITER ELEMENT) | TORQUE LIMITER (OUTER LIMITER ELEMENT) | THIRD SPEED REDUCER UNIT | SECOND SPEED REDUCER UNIT | FIRST SPEED REDUCER UNIT | MOTOR |
|---|---|---|---|---|---|---|---|---|---|
| WHEN ACCELERATOR PEDAL IS DEPRESSED (WHEN IT IS OPERATED NORMALLY) | ↻ | ↻ | ↻ | ↻ | ↻ | ↻ | ↻ | ↻ | ↻ |
| WHEN ACCELERATOR PEDAL IS RETURNED | ↺ | ↺ | ✗ | ✗ | ✗ | ✗ | ✗ | ✗ | ✗ |
| WHEN ACCELERATOR PEDAL IS DEPRESSED (WHEN TORQUE LIMITER IS OPERATED) | ↻ | ↻ | ↻ | ↻ | ✗ | ✗ | ✗ | ✗ | ✗ |

REACTIVE FORCE PEDAL DEVICE

TECHNICAL FIELD

The present invention relates to a reaction force pedal device having a pedal to be depressed by the driver of a vehicle and a motor for applying a reaction force to the pedal.

BACKGROUND ART

There is known an arrangement for applying a reaction force from an actuator to an accelerator pedal depending on the amount through which the accelerator pedal is operated {for example, Japanese Laid-Open Patent Publication No. 2007-026218 (hereinafter referred to as "JP2007-026218A")}. According to JP2007-026218A, an accelerator pedal 3 and a servomotor 19 are operatively coupled to each other by a pedal lever 5 and an arm 15. The servomotor 19 has a drive shaft 19b supporting on a distal end thereof a gear 19a that is held in mesh with a gear segment 15b on the pedal lever 5. The servomotor 19 applies a reaction force through the above structure to the accelerator pedal 3 (see Abstract and FIG. 1).

According to Japanese Laid-Open Patent Publication No. 2005-132225 (hereinafter referred to as "JP2005-132225A"), a depressing force changing means which comprises a variable friction plate 7, a fixed shaft 8, and an actuator 9 (e.g., an electromagnetic solenoid) is used to indicate a switchover of driving characteristics to the driver of a vehicle (see Abstract and [0011]). According to JP2005-132225A, furthermore, a one-way clutch 12 is disposed between a rotational shaft 3 to which an accelerator pedal 2 is fixed and the variable friction plate 7 (FIG. 10). When the accelerator pedal 2 is returned, the one-way clutch 12 prevents a frictional force of the variable friction plate 7 from being transmitted to the rotational shaft 3 (see [0038]).

SUMMARY OF INVENTION

As described above, according to JP2007-026218A, a reaction force is transmitted by a speed reducer mechanism which includes the gear 19a and the gear segment 15b. However, no details (such as a gear ratio, etc.) about the speed reducer mechanism are found in the description of the document.

JP2007-026218A shows the gear 19a and the gear segment 15b in FIGS. 1, 2, and 4. A review of these figures reveals that even when the gear 19a of the servomotor 19 is turned maximally, the gear 19a has only a portion thereof held in mesh with the gear segment 15b, and has another portion that remains out of mesh with the gear segment 15b. Consequently, a large force continues to be applied only to the portion of the gear 19a, which is thus partly worn badly and partly not worn at all. As a result, when the gear 19a of the servomotor 19 is turned through a maximum angular interval, the gear 19a may possibly become lower in overall durability than when the gear 19a is fully circumferentially brought into mesh with the gear segment 15b.

The fact that the gear 19a has only a portion thereof held in mesh with the gear segment 15b even when the gear 19a of the servomotor 19 is turned through a maximum angular interval means that the drive shaft 19b of the servomotor 19 rotates through a rotational angle less than 360°. Therefore, not only the gear 19a, but also various components of the servomotor 19 have localized portions to which forces are applied. The overall durability of the servomotor 19 thus becomes lower than when averaged forces are applied thereto. If the servomotor 19 is a brush motor, then since the brush motor has a commutator and brushes held in contact with each other in a limited range, only certain portions tend to be worn. As a consequence, there are developed steps between those portions which are worn badly and those portions which are not worn, resulting in a reduction in the overall durability of the servomotor 19. Differently worn surfaces are liable to cause noise and load steps (different resistances against the rotation of the servomotor 19), which are likely to make the user feel strange.

According to JP2005-132225A, the variable friction plate 7 and the one-way clutch 12 are mounted on the rotational shaft 3 to which the accelerator pedal 2 is fixed (FIG. 10). If the variable friction plate 7 and the one-way clutch 12 disclosed in JP2005-132225A are applied to the structure shown in JP2007-026218A, then the variable friction plate 7 and the one-way clutch 12 should be mounted on a lever shaft 7 (FIG. 1) to which the accelerator pedal 3 and the pedal lever 5 are fixed. Therefore, even if the variable friction plate 7 and the one-way clutch 12 disclosed in JP2005-132225A are applied to the structure shown in JP2007-026218A, the positional relationship between the gear 19a of the servomotor 19 and the gear segment 15b of the pedal lever does not change, and hence the problem of unevenly worn surfaces (uneven wear) remains unsolved.

The present invention has been made in view of the above problems. It is an object of the present invention to provide a reaction force pedal device which will increase the durability of a transmission system for transmitting a reaction force.

Another object of the present invention is to provide a reaction force pedal device which will not make the user feel strange.

According to the present invention, there is provide a reaction force pedal device comprising a pedal member to be depressed by the driver of a vehicle, a motor for applying a reaction force in a direction to return the pedal member when the driver depresses the pedal member, and a motor-side output shaft disposed on the motor for transmitting rotation of the motor to the pedal member, wherein a one-way clutch is disposed between the motor-side output shaft and the petal member, for allowing a rotational force to be transmitted when the pedal member is depressed and preventing a rotational force from being transmitted when the pedal member is returned.

According to the present invention, when the pedal member is depressed, a power force from the motor is transmitted through the one-way clutch to the pedal member to apply a reaction force to the pedal member that is depressed by the driver. When the pedal member is returned, the one-way clutch prevents a rotational force applied by the returning pedal member from being transmitted to the motor-side output shaft. Accordingly, the position (the operation amount) of the pedal member and the rotational angle of the motor-side output shaft are different before the pedal member starts being depressed and after the pedal member ends its returning movement (the pedal member is in its original position in each case). Stated otherwise, the corresponding relationship between the position (the operation amount) of the pedal member and the rotational angle of the motor-side output shaft changes when the pedal member in the original position starts to be depressed for the first time and when the pedal member in the original position starts to be depressed for the second time.

If the motor comprises a brush motor, for example, then it is possible to prevent the commutator and the brushes of the brush motor from contacting each other in a limited range and hence to prevent only certain portions from being unevenly worn.

The reaction force pedal device may further comprise a speed reducer disposed between the pedal member and the motor, for transmitting a drive force from the motor to the pedal member, wherein the speed reducer may include at least one pair of speed reducer gears and a speed-reducer-side output shaft for transmitting rotation of the motor-side output shaft to the pedal member, and the one-way clutch may be disposed between the motor-side output shaft and the speed-reducer-side output shaft.

If the one-way clutch is disposed between at least one speed reducer gear and the speed-reducer-side output shaft, then a rotational force applied by the returning pedal member is prevented from being transmitted to speed reducer gears that are closer to the motor than the one-way clutch.

Accordingly, the position (the operation amount) of the pedal member and the rotational angles of the speed reducer gears that are closer to the motor than the one-way clutch are different before the pedal member starts being depressed and after the pedal member ends its returning movement (the pedal member is in its original position in each case). Stated otherwise, the corresponding relationship between the position (the operation amount) of the pedal member and the rotational angles of the speed reducer gears that are closer to the motor than the one-way clutch changes when the pedal member in the original position starts to be depressed for the first time and when the pedal member in the original position starts to be depressed for the second time.

Therefore, the speed reducer gears that are closer to the motor than the one-way clutch have gear teeth meshing in different positions each time the pedal member is depressed, and hence have worn portions distributed rather than having only certain portions unevenly worn.

The pedal member may comprise a pad to be operated by the driver, a pedal-side arm having an end coupled to the pad and another end angularly movably supported on a vehicle body of the vehicle, a motor-side arm coupled to the speed-reducer-side output shaft and held displaceably against the pedal-side arm, for transmitting the drive force from the motor to the pedal-side arm, and an urging unit for urging the motor-side arm into contact with the pedal-side arm, wherein the speed reducer may have a plurality of pairs of speed reducer gears, and the one-way clutch may be disposed between one of the speed reducer gears which is closest to the speed-reducer-side output shaft and the speed-reducer-side output shaft.

Accordingly, the urging force of the urging unit can be reduced. In addition, it is possible to improve the driver's feeling at the time the driver depresses the pedal member.

Specifically, if at least one speed reducer gear (hereinafter referred to as "speed-reducer-output-shaft-side speed reducer gear") is disposed closer to the speed-reducer-side output shaft than the one-way clutch in an arrangement having a plurality of pairs of speed reducer gears, then the motor-side arm and the speed-reducer-output-shaft-side speed reducer gear are coupled to each other. If the urging unit should bring the motor-side arm into contact with the pedal-side arm while overcoming the inertia and frictional force of the speed-reducer-output-shaft-side speed reducer gear when the pedal member is returned, then it is necessary to relatively increase the urging force of the urging unit.

If the urging force of the urging unit is relatively increased, then the urging force that is transmitted to the driver when the pedal member is depressed is also relatively increased. Therefore, the load to be applied to the pedal member to depress the pedal member may possibly be unnecessarily large.

According to the present invention, however, the one-way clutch is disposed between the speed reducer gear closest to the speed-reducer-side output shaft and the speed-reducer-side output shaft. The one-way clutch prevents the inertia and frictional force of the speed reducer gear from acting on the motor-side arm when the pedal member is returned. Consequently, the urging force of the urging unit can be relatively reduced. In addition, the load to be applied to the pedal member to depress the pedal member does not need to be unnecessarily large, making it possible to improve the driver's feeling at the time the driver depresses the pedal member.

The reaction force pedal device may further comprise a torque limiter disposed between one of the speed reducer gears that is closest to the speed-reducer-side output shaft and the speed-reducer-side output shaft, for preventing a torque in excess of a predetermined value from being transmitted. Even in the event that the motor or either one of the speed reducer gears fails to move on account of some fault at the time the pedal member is depressed, the torque limiter allows the driver to depress the pedal member.

BRIEF DESCRIPTION OF DRAWINGS

FIG. 6 is a diagram showing the movements of various components of the accelerator pedal device at the time the accelerator pedal is operated.

DESCRIPTION OF EMBODIMENTS

A. Embodiment

1. Arrangement of Vehicle 10

(1) Overall Arrangement

Figure 1:
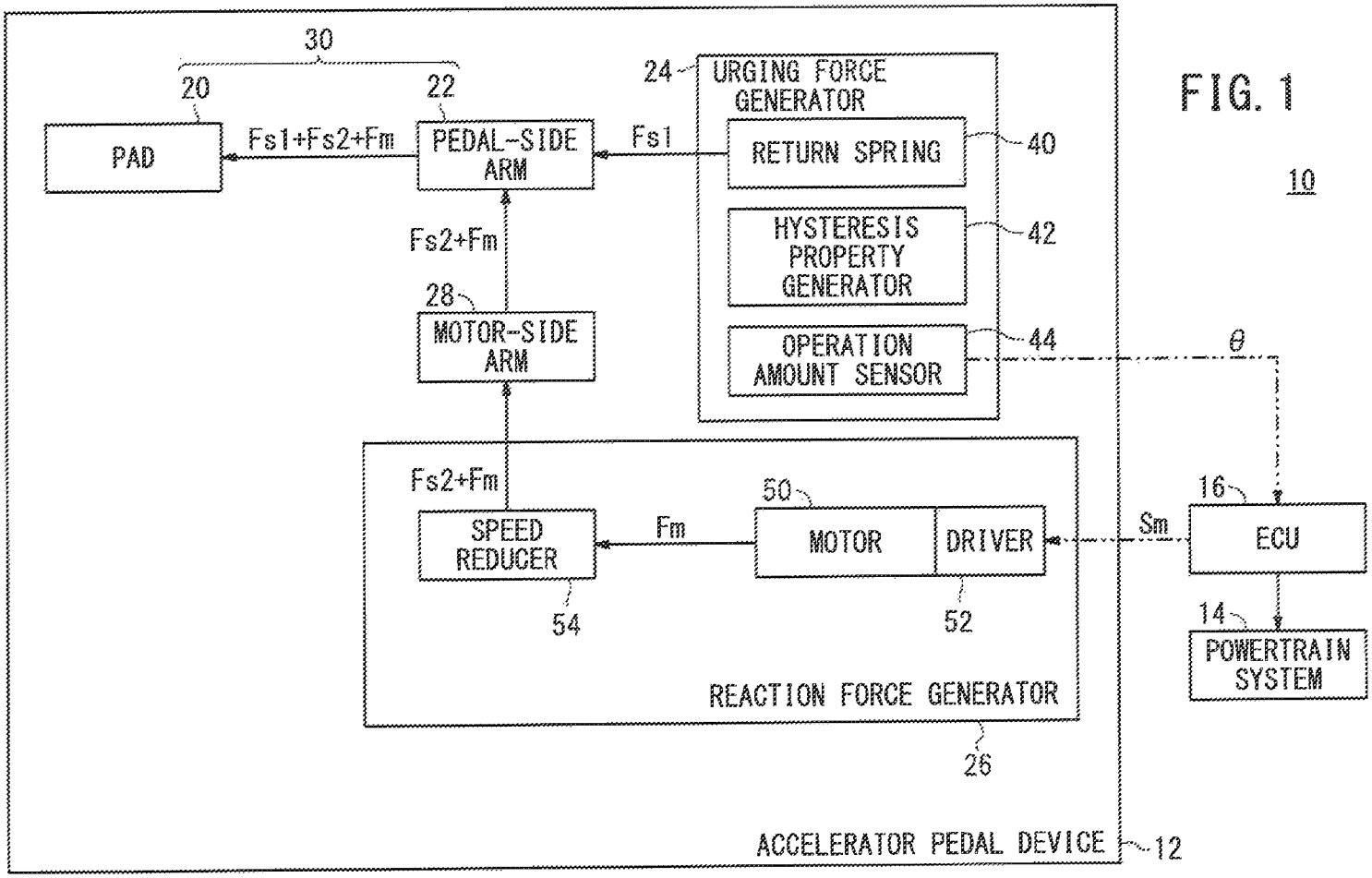
FIG. 1 is a block diagram of a vehicle incorporating an accelerator pedal device as a reaction force pedal device according to an embodiment of the present invention.
Figure 2:
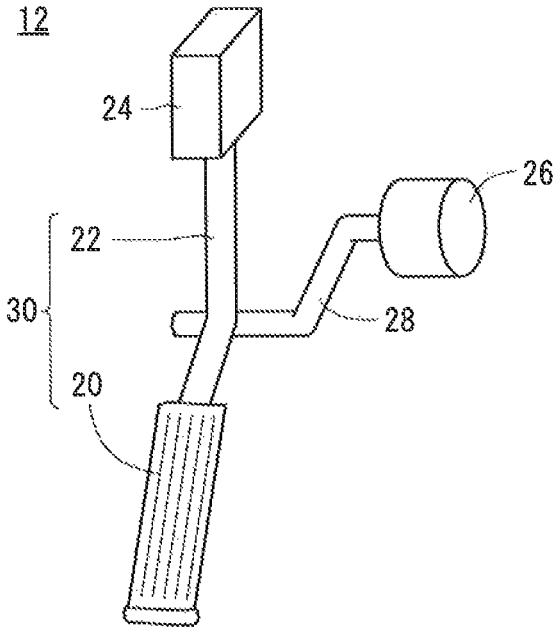
FIG. 2 is a perspective view schematically showing the appearance of components of the accelerator pedal device.

FIG. 1 is a block diagram of a vehicle 10 incorporating an accelerator pedal device 12 as a reaction force pedal device according to an embodiment of the present invention. FIG. 2 is a perspective view schematically showing the appearance of components of the accelerator pedal device 12. For example, the vehicle 10 comprises a gasoline-powered vehicle. Alternatively, the vehicle 10 may comprise an electric vehicle including a hybrid vehicle and a fuel battery vehicle.

The vehicle 10 includes, in addition to the accelerator pedal device 12, a powertrain system 14 and an electronic control unit 16 (hereinafter referred to as "ECU 16").

(2) Accelerator Pedal Device 12

The accelerator pedal device 12 has a pad 20 to be depressed by the driver, a pedal-side arm 22, an urging force generator 24, a reaction force generator 26, and a motor-side arm 28. The pad 20 and the pedal-side arm 22 will collectively be referred to as an accelerator pedal 30.

(a) Pedal-Side Arm 22

The pedal-side arm 22 has an end fixed to the pad 20 and another end swingably supported by the urging force generator 24 (see FIG. 2).

(b) Urging Force Generator 24

The urging force generator 24 mechanically generates an urging force (hereinafter referred to as "first urging force Fs1" [N]) for returning the accelerator pedal 30 that has been depressed to its original position. The urging force generator 24 applies the generated urging force through the pedal-side arm 22 to the pad 20. As shown in FIG. 1, the urging force generator 24 includes a return spring 40, a hysteresis property generator 42, and an operation amount sensor 44.

Figure 3:
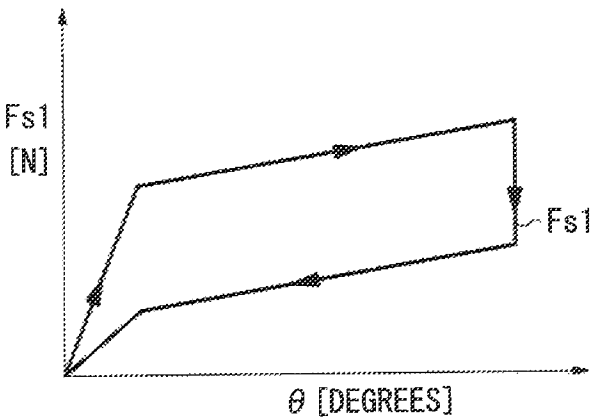
FIG. 3 is a diagram showing the relationship between the operation amount through which an accelerator pedal is depressed and a first urging force generated by an urging force generator.

The hysteresis property generator 42 generates a hysteresis property to be added to the first urging force Fs1 that is generated by the return spring 40. Specifically, as shown in FIG. 3, the hysteresis property generator 42 increases the first urging force Fs1 when the accelerator pedal 30 is depressed and reduces the first urging force Fs1 when the accelerator pedal 30 is returned.

The return spring 40 and the hysteresis property generator 42 may be of structures disclosed in International Publication No. WO 01/019638, for example.

The operation amount sensor 44 detects the angle θ [degrees] through which the accelerator pedal 30 is operated from its original position, depending on the displacement of the pedal-side arm 22, and supplies the detected angle θ to the ECU 16. The operation amount sensor 44 may be positioned outside of the urging force generator 24.

(c) Reaction Force Generator 26

Figure 4:
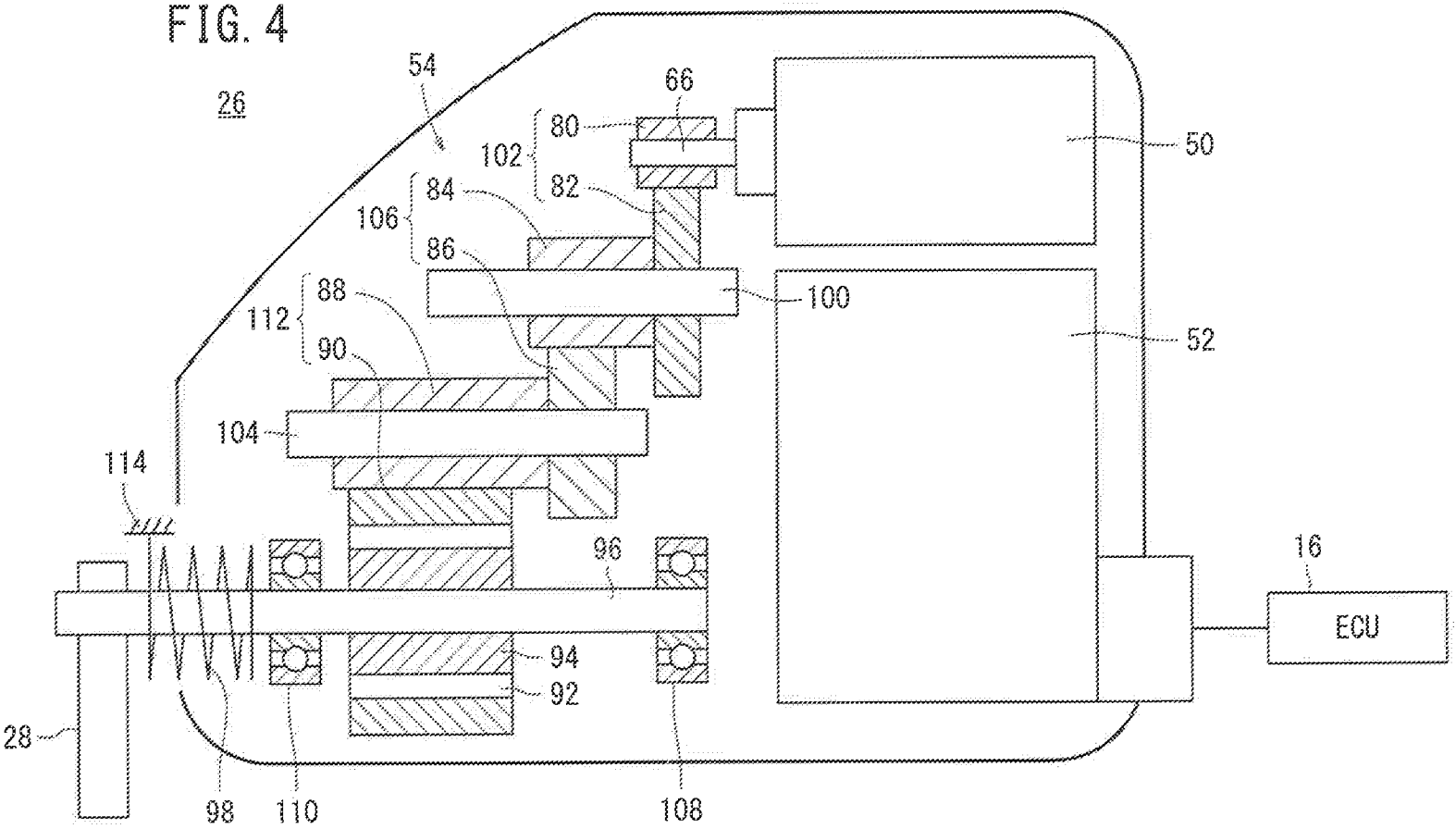
FIG. 4 is a view schematically showing the internal structure of a reaction force generator of the accelerator pedal device.

FIG. 4 is a view schematically showing the internal structure of the reaction force generator 26 of the accelerator pedal device 12. As shown in FIG. 4, the reaction force generator 26 generates a power force (hereinafter referred to as "motor power force Fm" [N]) to be applied to the accelerator pedal 30. The motor power force Fm is used as a reaction force that acts in a direction to return the accelerator pedal 30 when the driver depresses the accelerator pedal 30. As shown in FIGS. 1 and 4, the reaction force generator 26 has a motor 50 as an actuator, a driver 52 for controlling the motor 50, and a speed reducer 54.

Figure 5:
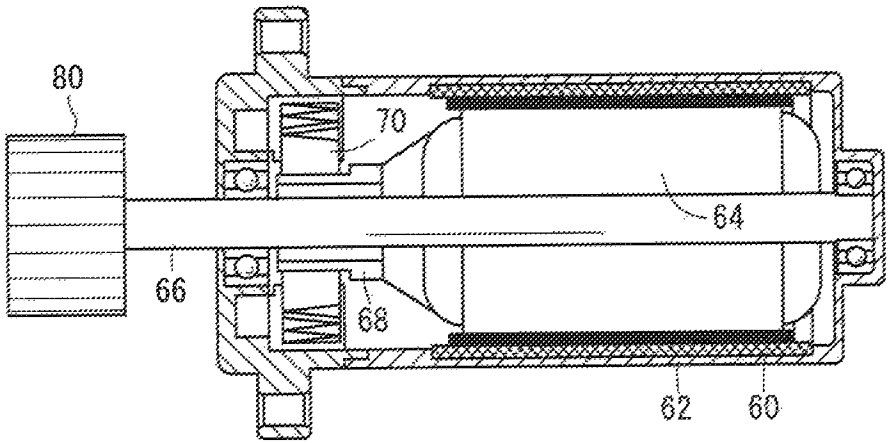
FIG. 5 is a view showing the internal structure of a motor in the embodiment.

FIG. 5 is a view showing the internal structure of the motor 50. The motor 50 generates a motor power force Fm based on a control signal from the driver 52. According to the present embodiment, the motor 50 comprises a DC brush motor. Alternatively, the motor 50 may comprise a DC brushless motor or an AC three-phase motor. Further alternatively, the motor 50 may be replaced with another drive force generating means such as a pneumatic actuator, for example.

As shown in FIG. 5, the motor 50 has a permanent magnet 60 fixedly mounted in a case 62, an armature 64 rotatable around the axis of an output shaft 66 of the motor 50 (hereinafter also referred to as "motor output shaft 66"), a commutator 68 for controlling the direction of an electric current, and brushes 70 for supplying an electric current to the armature 64 through the commutator 68. The motor 50 generates motor power force Fm that is transmitted through the motor output shaft 66 (motor-side output shaft) to the speed reducer 54.

The driver 52 controls the motor 50 depending on a control signal Sm from the ECU 16.

As shown in FIG. 4, the speed reducer 54 has first through sixth gears 80, 82, 84, 86, 88, 90 as speed reduction gears, the sixth gear 90 including a spur gear, a torque limiter 92, a one-way clutch 94, an output shaft 96 (hereinafter also referred to as "speed reducer output shaft 96"), and an additional spring 98 (urging unit).

The first gear 80 is mounted on the motor output shaft 66. The second gear 82 is mounted on a first intermediate shaft 100 rotatably supported on an inner wall surface, not shown, of a housing and held in mesh with the first gear 80. The first gear 80 and the second gear 82 jointly make up a first speed reducer unit 102. The third gear 84 is mounted on the first intermediate shaft 100, as with the second gear 82. The fourth gear 86 is mounted on a second intermediate shaft 104 rotatably supported on the inner wall surface of the housing and held in mesh with the third gear 84. The third gear 84 and the fourth gear 86 jointly make up a second speed reducer unit 106. The fifth gear 88 is mounted on the second intermediate shaft 104, as with the fourth gear 86. The sixth gear 90 is mounted on the output shaft 96 (speed-reducer-side output shaft) that is rotatably supported by bearings 108, 110 and fixed to the motor-side arm 28. The sixth gear 90 is held in mesh with the fifth gear 88. The fifth gear 88 and the sixth gear 90 jointly make up a third speed reducer unit 112. The speed reducer 54, which has three pairs of speed reducer gears as described above, includes three speed reducer units (first through third speed reducer units 102, 106, 112) for reducing speeds through three stages.

The torque limiter 92 has an inner limiter element, not shown in FIG. 4, fixed to the one-way clutch 94 on the side of the output shaft 96 and an outer limit element, not shown in FIG. 4, fixed to the sixth gear 90 on the side of the motor 50. When a predetermined torque is applied to the torque limiter 92, one of the inner limiter element and the outer limiter element slips against the other. Therefore, even in the event that the motor 50 or any one of the first through third speed reducer units 102, 106, 112 fails to move, the output shaft 96 can be turned by the accelerator pedal 30 when it is depressed.

The one-way clutch 94 has an inner clutch element, not shown in FIG. 4, fixed to the output shaft 96 and an outer clutch element, not shown in FIG. 4, fixed to the inner limiter element of the torque limiter 92 on the side of the motor 50. When the accelerator pedal 30 is depressed, the inner clutch element and the outer clutch element are turned in unison with each other. When the accelerator pedal 30 is returned, only the inner clutch element is turned, and the outer clutch element is not turned.

The additional spring 98 comprises a helical spring having an end fixed to the output shaft 96 and another end fixed to a bracket 114. The additional spring 98 generates an urging force (hereinafter referred to as "second urging force Fs2" [N]) for urging the output shaft 96 to return the motor-side arm 28 coupled to the output shaft 96 to its original position. The motor-side arm 28 has a portion that is held in contact with a portion of the pedal-side arm 22 at all times (see FIG. 2). The speed reducer 54 applies the second urging force Fs2 and the motor power force Fm through the motor-side arm 28 to the pedal-side arm 22.

(d) Motor-Side Arm 28

The motor-side arm 28 has an end coupled to an end of the speed reducer output shaft 96 (see FIG. 4). Therefore, the motor-side arm 28 and the speed reducer output shaft 96 are coordinated with each other in operation.

(3) Powertrain System 14

The powertrain system 14 applies a drive force to the vehicle 10, and includes an engine, a transmission, road wheels, etc., not shown.

(4) ECU 16

The ECU 16 controls the powertrain system 14 and the reaction force generator 26 based on the operation amount θ of the accelerator pedal 30 detected by the operation amount sensor 44 and the vehicle speed detected by a vehicle speed sensor, not shown, and the like. The ECU 16 may control the motor power force Fm according to the arrangement disclosed in International Publication No. WO 2009/136512, for example.

2. Overall Movement made when the Accelerator Pedal 30 is Operated

The accelerator pedal device 12 according to the present embodiment is constructed as described above. When the accelerator pedal 30 is depressed and returned, the accelerator pedal device 12 makes overall movement as described below. When necessary, a direction in which various components are moved or turned when the accelerator pedal 30 is depressed will be referred to as "forward direction", whereas a direction in which various components are moved or turned when the accelerator pedal 30 is returned will be referred to as "reverse direction".

(1) When the Accelerator Pedal 30 is Depressed

When the driver depresses the accelerator pedal 30, the accelerator pedal 30 is turned in the forward direction about the urging force generator 24, and has its distal end moved downwardly (see FIG. 2). The pedal-side arm 22 has its end turned downwardly while changing a relative angle formed between itself and the accelerator pedal 30. At this time, the pedal-side arm 22 receives the first urging force Fs1 from the urging force generator 24 (return spring 40).

When the pedal-side arm 22 is turned downwardly, the portion of the pedal-side arm 22 presses the portion of the motor-side arm 28. As a result, the portion of the pedal-side arm 22 moves downwardly in unison with the portion of the motor-side arm 28. Since the additional spring 98 is torsionally tensioned as the motor-side arm 28 is turned, the motor-side arm 28 is subject to the second urging force Fs2 as an origin returning force.

Based on the operation amount θ detected by the operation amount sensor 44, the ECU 16 sets an output power force of the motor 50, i.e., controls the motor 50 to generate the motor power force Fm. The motor power force Fm is transmitted through the speed reducer 54 to the motor-side arm 28 (movements in the speed reducer 54 will be described later).

Therefore, the motor-side arm 28 is subject to the depressing force that the driver has applied to the accelerator pedal 30, the first urging force Fs1 from the return spring 40, the motor power force Fm from the motor 50, and the second urging force Fs2 from the additional spring 98 (see FIG. 1).

(2) When the Accelerator Pedal 30 is Returned

When the driver returns the accelerator pedal 30, the accelerator pedal 30 is turned in the reverse direction about the urging force generator 24 under the first urging force Fs1 from the return spring 40. At this time, the second urging force Fs2 from the additional spring 98 acts on the speed reducer output shaft 96. Therefore, the motor-side arm 28 coupled to the speed reducer output shaft 96 is turned in the reverse direction, keeping itself in contact with the pedal-side arm 22.

When the driver returns the accelerator pedal 30, the components of the reaction force generator 26 which are positioned closer to the motor 50 than the one-way clutch 94, i.e., the motor output shaft 66, the first through sixth gears 80, 82, 84, 86, 88, 90, and the torque limiter 92, are disconnected from the speed reducer output shaft 96, by the operation of the one-way clutch 94, as described in detail later.

3. Movements in the Speed Reducer 54 when the Accelerator Pedal 30 is Operated FIG. 6 is a diagram showing the movements of various components of the accelerator pedal device 12 at the time the accelerator pedal 30 is operated. In FIG. 6, clockwise arrows indicate movements in the forward direction, i.e., the direction in which various components are moved or turned when the accelerator pedal 30 is depressed, and counterclockwise arrows indicate movements in the reverse direction, i.e., the direction in which various components are moved or turned when the accelerator pedal 30 is returned. It should be noted that the illustrated directions do not necessarily agree with directions in which the various components are actually moved or turned. Cross marks in FIG. 6 indicate that the corresponding components are not moved when the accelerator pedal 30 is depressed or returned.

As described above, the speed reducer 54 according to the present embodiment includes the one-way clutch 94. Therefore, as shown in FIG. 6, the components are moved differently when the accelerator pedal 30 is depressed and returned.

Specifically, when the accelerator pedal 30 is depressed, i.e., when it is operated normally, the speed reducer output shaft 96, the one-way clutch 94 (the inner clutch element and the outer clutch element), the torque limiter 92 (the inner limiter element and the outer limiter element), the third speed reducer unit 112 (the fifth gear 88 and the sixth gear 90), the second speed reducer unit 106 (the third gear 84 and the fourth gear 86), the first speed reducer unit 102 (the first gear 80 and the second gear 82), and the motor 50 (the output shaft 96) are turned in the same direction, i.e., the forward direction (see the arrows in the first line of FIG. 6). It should be noted that the motor power force Fm generated by the motor 50 at this time is in the reverse direction.

When the accelerator pedal 30 is returned, the one-way clutch 94 is operated to allow the speed reducer output shaft 96 and the inner clutch element of the one-way clutch 94 to turn in the reverse direction, and to keep the other components, i.e., the outer clutch element of the one-way clutch 94, the torque limiter 92 (the inner limiter element and the outer limiter element), the first through third speed reducer units 102, 106, 112, and the motor 50, unturned and still (see the arrows in the second line of FIG. 6).

Consequently, the correlation between the operation amount θ of the accelerator pedal 30 and rotational angles of the motor output shaft 66 and the first through third speed reducer units 102, 106, 112 (the first through sixth gears 80, 82, 84, 86, 88, 90) becomes different.

The speed reducer 54 according to the present embodiment includes the torque limiter 92. Therefore, if the motor 50 and the first through third speed reducer units 102, 106, 112 fail to move in the event that the motor 50 or any one of the first through third speed reducer units 102, 106, 112 (the first through sixth gears 80, 82, 84, 86, 88, 90) is unable to move, then the various components are moved as indicated by the cross marks in the third line of FIG. 6.

Specifically, when the driver depresses the accelerator pedal 30 while some of the components fail to move as described above, the speed reducer output shaft 96 and the one-way clutch 94 (the inner clutch element and the outer clutch element) are turned, applying a torque in excess of a predetermined value to the torque limiter 92. When such a torque is applied to the torque limiter 92, the inner limiter element thereof slips against the outer limiter element thereof. Therefore, only the speed reducer output shaft 96, the one-way clutch 94, the inner limiter element are turned, and the other components, i.e., the outer limiter element of the torque limiter 92, the first through third speed reducer units 102, 106, 112 (the first through sixth gears 80, 82, 84, 86, 88, 90), and the motor output shaft 66 keep unturned and still (see the arrows in the third line of FIG. 6).

Consequently, even if the motor 50 and the first through third speed reducer units 102, 106, 112 fail to move in the event that the motor 50 or any one of the first through third speed reducer units 102, 106, 112 (the first through sixth gears 80, 82, 84, 86, 88, 90) is unable to move, it is possible to turn the speed reducer output shaft 96, i.e., to operate the accelerator pedal 30.

4. Advantages of the Present Embodiment

According to the present embodiment, as described above, when the accelerator pedal 30 (pedal member) is depressed, the motor power force Fm is transmitted through the speed reducer 54 to the accelerator pedal 30, applying a reaction force to the accelerator pedal 30 against the depressing force applied by the driver. When the accelerator pedal 30 is returned, the one-way clutch 94 disposed between the sixth gear 90 (speed reducer gear) and the speed reducer output shaft 96 prevents a rotational force applied by the returning accelerator pedal 30 from being transmitted to the motor output shaft 66 (motor-side output shaft) and the first through sixth gears 80, 82, 84, 86, 88, 90 (speed reducer gears).

Accordingly, the position (the operation amount θ) of the accelerator pedal 30 and the rotational angles of the motor output shaft 66 and the first through sixth gears 80, 82, 84, 86, 88, 90 are different before the accelerator pedal 30 starts being depressed and after the accelerator pedal 30 ends its returning movement (the accelerator pedal 30 is in its original position in each case). Stated otherwise, the corresponding relationship between the position (the operation amount θ) of the accelerator pedal 30 and the rotational angles of the motor output shaft 66 and the first through sixth gears 80, 82, 84, 86, 88, 90 changes when the accelerator pedal 30 in the original position starts to be depressed for the first time and when the accelerator pedal 30 in the original position starts to be depressed for the second time.

Therefore, it is possible to prevent the commutator 68 and the brushes 70 of the motor 50 from contacting each other in a limited range and hence to prevent only certain portions from being unevenly worn. In addition, the first through sixth gears 80, 82, 84, 86, 88, 90 have gear teeth meshing in different positions each time the accelerator pedal 30 is depressed, and hence have worn portions distributed rather than having only certain portions unevenly worn.

According to the present embodiment, the speed reducer 54 has the first through third speed reducer units 102, 106, 112 (the first through sixth gears 80, 82, 84, 86, 88, 90), or stated otherwise, has a plurality of pairs of speed reducer gears, and the one-way clutch 94 is disposed between the sixth gear 90 closest to the speed reducer output shaft 96 and the speed reducer output shaft 96. The one-way clutch 94 thus positioned makes it possible to reduce the second urging force Fs2 generated by the additional spring 98, and also to improve the driver's feeling at the time the driver depresses the accelerator pedal 30.

Specifically, if at least one speed reducer gear (hereinafter referred to as "speed-reducer-output-shaft-side speed reducer gear") is disposed closer to the speed reducer output shaft 96 than the one-way clutch 94 in an arrangement having the first through third speed reducer units 102, 106, 112, then the motor-side arm 28 and the speed-reducer-output-shaft-side speed reducer gear are coupled to each other. For example, if the one-way clutch 94 is disposed between the fifth gear 88 and the second intermediate shaft 104, then the motor-side arm 28 and the sixth gear 90 (the speed-reducer-output-shaft-side speed reducer gear) are coupled to each other. If the additional spring 98 (urging unit) should bring the motor-side arm 28 into contact with the pedal-side arm 22 while overcoming the inertia and frictional force of the speed-reducer-output-shaft-side speed reducer gear when the accelerator pedal 30 is returned, then it is necessary to relatively increase the urging force of the additional spring 98.

If the second urging force Fs2 of the additional spring 98 is relatively increased, then the urging force (the sum of the first urging force Fs1, the second urging force Fs2, and the motor power force Fm) that is transmitted to the driver when the accelerator pedal 30 is depressed is also relatively increased. Therefore, the load to be applied to the accelerator pedal 30 to depress the accelerator pedal 30 may possibly be unnecessarily large.

According to the present embodiment, however, the one-way clutch 94 is disposed between the sixth gear 90 closest to the speed reducer output shaft 96 and the speed reducer output shaft 96. The one-way clutch 94 prevents the inertia and frictional force of the speed reducer gear from acting on the motor-side arm 28 when the accelerator pedal 30 is returned. Consequently, the second urging force Fs2 generated by the additional spring 98 can be relatively reduced. In addition, the load to be applied to the accelerator pedal 30 to depress the accelerator pedal 30 does not need to be unnecessarily large, making it possible to improve the driver's feeling at the time the driver depresses the accelerator pedal 30.

According to the present embodiment, the accelerator pedal device 12 includes the torque limiter 92 that is disposed between the sixth gear 90 closest to the speed reducer output shaft 96 and the speed reducer output shaft 96, for limiting the transmission of a torque in excess of a predetermined value. Even in the event that the motor 50 or any one of the first through sixth gears 80, 82, 84, 86, 88, 90 fails to move on account of some fault at the time the accelerator pedal 30 is depressed, the torque limiter 92 allows the driver to depress the accelerator pedal 30.

B. Modifications

The present invention is not limited to the above embodiment, but may adopt various arrangements based on the disclosure of the above description. For example, the present invention may adopt the following arrangements:

1. Vehicle 10

In the above embodiment, the vehicle 10 is a gasoline-powered vehicle. However, the vehicle 10 is not limited to a gasoline-powered vehicle, but may be an electric vehicle including a hybrid vehicle and a fuel battery vehicle.

2. Accelerator Pedal 30

In the above embodiment, the pedal that applies the motor power force Fm is the accelerator pedal 30. However, the same arrangement may be applied to a brake pedal. Specifically, at least one of the torque limiter 92 and the one-way clutch 94 may be applied to an arrangement which is capable of applying the motor power force Fm to a brake pedal.

3. Urging Force Generator 24

In the above embodiment, the urging force generator 24 is only of a mechanical structure. However, the urging force generator 24 may have an electric or electromagnetic mechanism.

4. Reaction Force Generator 26

In the above embodiment, the motor 50 is used to generate a reaction force (urging force) to be applied to the accelerator pedal 30. However, the present invention is not limited to the motor 50, but may use any drive force generating means that is capable of adjusting a reaction force depending on a command from the ECU 16. For example, a pneumatic actuator may be used instead of the motor 50.

In the above embodiment, the motor power force Fm is transmitted through the motor-side arm 28 to the accelerator pedal 30. However, the present invention is not limited to such a transmission system, but the motor power force Fm may be transmitted directly from the reaction force generator 26 to the accelerator pedal 30. Alternatively, the motor-side arm 28 may be inseparably, but relatively displaceably, coupled to the pedal-side arm 22, e.g., may be rotatably supported on a portion of the pedal-side arm 22.

In the above embodiment, the speed reducer 54 includes the three pairs of speed reducer gears, i.e., the first through sixth gears 80, 82, 84, 86, 88, 90 (the first through third speed reducer units 102, 106, 112). However, the number of speed reducer gears and the number of speed reducer units are not limited to the illustrated numbers. The number of speed reducer gears may be 2 or 4 (one pair or two pairs) (the number of speed reducer units is 1 or 2), or the number of speed reducer gears may be 8 (four pairs) or greater (the number of speed reducer units is 4 or greater). While each of the first through sixth gears 80, 82, 84, 86, 88, 90 comprises a spur gear in the illustrated embodiment, it may be any of various other gear types, e.g., a helical gear, a double helical gear, a rack and pinion, or the like.

In the above embodiment, the speed reducer 54 is disposed between the motor-side arm 28 and the motor 50. However, the speed reducer 54 may be dispensed with, and the torque limiter 92 and the one-way clutch 94 may be mounted on the motor output shaft 66, for example.

In the above embodiment, the speed reducer 54 includes both the torque limiter 92 and the one-way clutch 94. However, the speed reducer may include either one of the torque limiter 92 and the one-way clutch 94.

In the above embodiment, the torque limiter 92 is disposed between the sixth gear 90 and the one-way clutch 94. However, if the one-way clutch 94 is included, then the torque limiter 92 may be disposed anywhere between the accelerator pedal 30 and the motor output shaft 66. For example, the torque limiter 92 may be disposed between the one-way clutch 94 and the speed reducer output shaft 96. Alternatively, the torque limiter 92 may be disposed between the fifth gear 88 and the second intermediate shaft 104.

In the above embodiment, the one-way clutch 94 is disposed between the torque limiter 92 and the speed reducer output shaft 96. However, the one-way clutch 94 may be disposed anywhere between the accelerator pedal 30 and the motor output shaft 66. For example, the one-way clutch 94 may be disposed between the sixth gear 90 and the torque limiter 92. Alternatively, the one-way clutch 94 may be disposed between the fifth gear 88 and the second intermediate shaft 104.

In the above embodiment, the additional spring 98 comprises a helical spring (see FIG. 4). However, the additional spring 98 may comprise another urging means. For example, the additional spring 98 may comprise a spring other than a helical spring, for example, a leaf spring.

In the above embodiment, the additional spring 98 has an end fixed to the speed reducer output shaft 96 (see FIG. 4) for directly urging the speed reducer output shaft 96. However, the additional spring 98 may be positioned otherwise insofar as it can urge the motor-side arm 28 toward the pedal-side arm 22. For example, the additional spring 98 may have an end directly fixed to the pedal-side arm 22.

The invention claimed is:

1. A reaction force pedal device comprising:

a pedal member configured to be depressed by a driver of a vehicle;

a motor for applying a reaction force in a direction to return the pedal member toward an initial position thereof after the driver depresses the pedal member;

a motor-side output shaft disposed on the motor for transmitting rotation of the motor toward the pedal member; and a speed reducer disposed between the pedal member and the motor, for transmitting a drive force from the motor to the pedal member, wherein a one-way clutch is disposed between the motor-side output shaft and the pedal member, for allowing a rotational force to be transmitted when the pedal member is depressed and preventing a rotational force from being transmitted when the pedal member is returned, wherein the speed reducer includes a speed-reducer-side output shaft for transmitting rotation of the motor-side output shaft to the pedal member, wherein the pedal member comprises:

a pad to be operated by the driver; and a pedal-side arm having an end coupled to the pad and another end angularly movably supported on a vehicle body of the vehicle:

and wherein the reaction force pedal device further comprises:

a motor-side arm coupled to the speed-reducer-side output shaft and held in displaceable contact with the pedal-side arm, for transmitting the drive force from the motor to the pedal-side arm; and an urging unit for urging the motor-side arm into contact with the pedal-side arm.

2. The reaction force pedal device according to claim 1, the one-way clutch is disposed between the motor-side output shaft and the speed-reducer-side output shaft.

3. The reaction force pedal device according to claim 2, wherein the speed reducer has a plurality of pairs of speed reducer gears; and the one-way clutch is disposed between one of the speed reducer gears that is closest to the speed-reducer-side output shaft and the speed-reducer-side output shaft.

4. The reaction force pedal device according to claim 1, further comprising:

a torque limiter disposed between one of at least one pair of speed reducer gears that is closest to the speed-reducer-side output shaft and the speed-reducer-side output shaft, for preventing a torque in excess of a predetermined value from being transmitted.

5. A reaction force pedal device comprising:

a pedal member configured to be depressed by a driver of a vehicle, the pedal member comprising a pad configured to be contacted by a foot of the driver, and a pedal-side arm attached to an upper end of the pad;

an urging force generator operatively connected to the pedal-side arm, the urging force generator comprising a return spring and an operation amount sensor for sensing an amount of travel of the pedal member;

a reaction force generator comprising a motor for applying a reaction force in a direction to return the pedal member toward an initial position thereof after the driver depresses the pedal member, the motor comprising a motor-side output shaft;

a speed reducer disposed between the pedal member and the motor, for transmitting a drive force from the motor to the pedal member; and a motor-side arm for contacting the pedal-side arm and urging the pedal member toward its initial position in response to rotary movement of the motor-side output shaft;

wherein a one-way clutch is disposed between the motor-side output shaft and the pedal member, for allowing a rotational force to be transmitted when the pedal member is depressed and preventing a rotational force from being transmitted when the pedal member is returned.

6. The reaction force pedal device according to claim 5, wherein the one-way clutch is disposed between the motor-side output shaft and the speed-reducer-side output shaft.

7. The reaction force pedal device according to claim 5, wherein:

the speed reducer comprises a plurality of pairs of speed reducer gears; and the one-way clutch is disposed between one gear of a pair of the speed reducer gears that is closest to the speed-reducer-side output shaft, and the speed-reducer-side output shaft.

8. The reaction force pedal device according to claim 7, further comprising:

a torque limiter disposed between one of at least one pair of the speed reducer gears that is closest to the speed-reducer-side output shaft and the speed-reducer-side output shaft, for preventing a torque in excess of a predetermined value from being transmitted.

* * * * *